US010109231B2

(12) United States Patent
Enami

(10) Patent No.: US 10,109,231 B2
(45) Date of Patent: Oct. 23, 2018

(54) ELECTROOPTICAL DEVICE, METHOD FOR CONTROLLING ELECTROOPTICAL DEVICE, AND ELECTRONIC APPARATUS

(71) Applicant: SEIKO EPSON CORPORATION, Tokyo (JP)

(72) Inventor: Shinta Enami, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/640,972

(22) Filed: Jul. 3, 2017

(65) Prior Publication Data

US 2018/0033364 A1 Feb. 1, 2018

(30) Foreign Application Priority Data

Jul. 26, 2016 (JP) ..... 2016-146020

(51) Int. Cl.
*G09G 3/36* (2006.01)
*G09G 3/20* (2006.01)

(52) U.S. Cl.
CPC ..... *G09G 3/2096* (2013.01); *G09G 3/3614* (2013.01); *G09G 3/3648* (2013.01); *G09G 3/3674* (2013.01); *G09G 3/3688* (2013.01); *G09G 2310/0213* (2013.01); *G09G 2310/0243* (2013.01); *G09G 2310/0251* (2013.01); *G09G 2310/0297* (2013.01); *G09G 2310/08* (2013.01); *G09G 2370/08* (2013.01)

(58) Field of Classification Search
CPC ..... G09G 3/3685; G09G 3/3688
See application file for complete search history.

(56) References Cited

U.S. PATENT DOCUMENTS

2007/0069214 A1* 3/2007 Lee ..... G09G 3/3648 257/72
2008/0309599 A1* 12/2008 Tsuda ..... G09G 3/3688 345/88
2009/0179835 A1* 7/2009 Ito ..... G09G 3/3688 345/76

(Continued)

FOREIGN PATENT DOCUMENTS

JP H07-287555 A 10/1995
JP 2007-212956 A 8/2007
WO 09/116201 A1 9/2009

*Primary Examiner* — Christopher Kohlman
(74) *Attorney, Agent, or Firm* — Oliff PLC

(57) ABSTRACT

An electrooptical device includes: a first signal line group; a second signal line group; a signal distribution circuit that executes a distribution operation of distributing first data signals to signal lines in the first signal line group and distributing second data signals to signal lines in the second signal line group; a first supply circuit that supplies the first data signals to the signal distribution circuit and supplies first selection signals for controlling distribution of the first data signals to the signal lines in the first signal line group; a second supply circuit that supplies the second data signals to the signal distribution circuit and supplies second selection signals for controlling distribution of the second data signals to the signal lines in the second signal line group; and a selection circuit that controls output of the first selection signals and the second selection signals to the signal distribution circuit.

20 Claims, 11 Drawing Sheets

(56) References Cited

U.S. PATENT DOCUMENTS

| | | | | |
|---|---|---|---|---|
| 2009/0267877 | A1* | 10/2009 | Yen | G09G 3/006 345/87 |
| 2011/0032226 | A1 | 2/2011 | Sasaki | |
| 2014/0210699 | A1* | 7/2014 | Liu | G09G 3/3688 345/98 |
| 2016/0267716 | A1* | 9/2016 | Patel | G09G 5/395 |

* cited by examiner

B[1] (K NUMBERS)
B[2] (K NUMBERS)
B[J−1] (K NUMBERS)
B[J] (K NUMBERS)
14
58[1]
58[2]
58[K]
C[1]
C[2]
C[J−1]
C[J]
16
21[1]
21[2]
21[J−1]
21[J]
21
10
61[1]
61[2]
61
61[K]
SEL[1]
SEL[2]
SEL[K]
FIRST SUPPLY CIRCUIT
SECOND SUPPLY CIRCUIT
200a1
200b1
60a
60b
CONTROL SIGNAL SUPPLY CIRCUIT
SEL1[1]
Co1[1]
SEL1[2]
Co1[2]
SEL1[K]
Co1[K]
SEL2[1]
Co2[1]
SEL2[2]
Co2[2]
SEL2[K]
Co2[K]
59a[1]
59a[2]
59a[K]
59b[1]
59b[2]
59b[K]
200a2
200b2
200c

FIG. 7

| LINE | Hrot | | FRAME | | | | |
|---|---|---|---|---|---|---|---|
| | | | n−1 | n | n+1 | n+2 | n+3 |
| | | | Vrot=1 | Vrot=1 | Vrot=1 | Vrot=1 | Vrot=1 |
| m−1 | 1 | Aout | 0 | 1 | 0 | 1 | 0 |
| | | FIRST SUPPLY CIRCUIT 200a1 | 12345678 | | 12345678 | | 12345678 |
| | | SECOND SUPPLY CIRCUIT 200b1 | | 12345678 | | 12345678 | |
| m | 0 | Aout | 1 | 0 | 1 | 0 | 1 |
| | | FIRST SUPPLY CIRCUIT 200a1 | | 12345678 | | 12345678 | |
| | | SECOND SUPPLY CIRCUIT 200b1 | 12345678 | | 12345678 | | 12345678 |
| m+1 | 1 | Aout | 0 | 1 | 0 | 1 | 0 |
| | | FIRST SUPPLY CIRCUIT 200a1 | 12345678 | | 12345678 | | 12345678 |
| | | SECOND SUPPLY CIRCUIT 200b1 | | 12345678 | | 12345678 | |
| m+2 | 0 | Aout | 1 | 0 | 1 | 0 | 1 |
| | | FIRST SUPPLY CIRCUIT 200a1 | | 12345678 | | 12345678 | |
| | | SECOND SUPPLY CIRCUIT 200b1 | 12345678 | | 12345678 | | 12345678 |
| m+3 | 1 | Aout | 0 | 1 | 0 | 1 | 0 |
| | | FIRST SUPPLY CIRCUIT 200a1 | 12345678 | | 12345678 | | 12345678 |
| | | SECOND SUPPLY CIRCUIT 200b1 | | 12345678 | | 12345678 | |

FIG. 9

| LINE | Hrot | | FRAME | | | | |
|---|---|---|---|---|---|---|---|
| | | | n−1 | n | n+1 | n+2 | n+3 |
| | | | Vrot=1 | Vrot=1 | Vrot=1 | Vrot=1 | Vrot=1 |
| m−1 | 1 | Aout | 0 | 1 | 0 | 1 | 0 |
| | | FIRST SUPPLY CIRCUIT 200a1 | 1 3 5 7 | 2 4 6 8 | 1 3 5 7 | 2 4 6 8 | 1 3 5 7 |
| | | SECOND SUPPLY CIRCUIT 200b1 | 2 4 6 8 | 1 3 5 7 | 2 4 6 8 | 1 3 5 7 | 2 4 6 8 |
| m | 0 | Aout | 1 | 0 | 1 | 0 | 1 |
| | | FIRST SUPPLY CIRCUIT 200a1 | 2 4 6 8 | 1 3 5 7 | 2 4 6 8 | 1 3 5 7 | 2 4 6 8 |
| | | SECOND SUPPLY CIRCUIT 200b1 | 1 3 5 7 | 2 4 6 8 | 1 3 5 7 | 2 4 6 8 | 1 3 5 7 |
| m+1 | 1 | Aout | 0 | 1 | 0 | 1 | 0 |
| | | FIRST SUPPLY CIRCUIT 200a1 | 1 3 5 7 | 2 4 6 8 | 1 3 5 7 | 2 4 6 8 | 1 3 5 7 |
| | | SECOND SUPPLY CIRCUIT 200b1 | 2 4 6 8 | 1 3 5 7 | 2 4 6 8 | 1 3 5 7 | 2 4 6 8 |
| m+2 | 0 | Aout | 1 | 0 | 1 | 0 | 1 |
| | | FIRST SUPPLY CIRCUIT 200a1 | 2 4 6 8 | 1 3 5 7 | 2 4 6 8 | 1 3 5 7 | 2 4 6 8 |
| | | SECOND SUPPLY CIRCUIT 200b1 | 1 3 5 7 | 2 4 6 8 | 1 3 5 7 | 2 4 6 8 | 1 3 5 7 |
| m+3 | 1 | Aout | 0 | 1 | 0 | 1 | 0 |
| | | FIRST SUPPLY CIRCUIT 200a1 | 1 3 5 7 | 2 4 6 8 | 1 3 5 7 | 2 4 6 8 | 1 3 5 7 |
| | | SECOND SUPPLY CIRCUIT 200b1 | 2 4 6 8 | 1 3 5 7 | 2 4 6 8 | 1 3 5 7 | 2 4 6 8 |

ELECTROOPTICAL DEVICE, METHOD FOR CONTROLLING ELECTROOPTICAL DEVICE, AND ELECTRONIC APPARATUS

BACKGROUND

1. Technical Field

The present invention relates to an electrooptical device, a method for controlling an electrooptical device, and an electronic apparatus.

2. Related Art

In a high-definition electrooptical device, in a case where only a single driving circuit outputs data signals, a large load is applied to the single driving circuit. As a method of reducing the load, a method of outputting data signals using a plurality of (two) driving circuits is known (refer to JP-A-2007-212956).

Meanwhile, there is a case where the electrooptical device includes distribution circuits such as demultiplexers that distribute the data signals output from the driving circuits to a plurality of signal lines according to a plurality of selection signals. Here, the plurality of selection signals for the distribution circuits can be output from each of the driving circuits in addition to the data signals. In this case, a case that controls the distribution circuits using only the plurality of selection signals output from any one of the plurality of driving circuits, is considered.

However, in this case, there is a difference in an operation condition in which the driving circuits supply or do not supply the selection signals to the distribution circuits. In the driving circuit that does not supply the selection signals to the distribution circuits, there is no variation in the power supply voltage due to the output of the selection signals. However, in the driving circuit that supplies the selection signals to the distribution circuits, the power supply voltage varies due to the output of the selection signals. The difference in the operation condition causes variations in the data signals between the driving circuits, and this may cause deterioration in image quality.

On the other hand, a case where all of the selection signals output from each of the plurality of driving circuits are simply supplied to the distribution circuits, is considered.

However, there is a concern that a phase difference may occur between the corresponding selection signals output from different driving circuits due to influence of the individual variation of each driving circuit or the like. That is, when the selection signals output from one driving circuit are in a high level, the selection signals output from the other driving circuit may be in a low level. For this reason, there is a concern that a period for which the selection signals become active may shorten, and that output timing of the data signals from the distribution circuit may deviate from a predetermined timing. The variation in output timing of the data signals causes deterioration in image quality.

SUMMARY

An advantage of some aspects of the invention is to improve image quality in the case of driving the electrooptical device using a plurality of generation circuits which generate the data signals and the selection signals.

An electrooptical device according to an aspect of the invention includes: a first signal line group; a second signal line group different from the first signal line group; a signal distribution circuit that executes a distribution operation of distributing first data signals to signal lines in the first signal line group and distributing second data signals to signal lines in the second signal line group; a first supply circuit that supplies the first data signals to the signal distribution circuit and supplies first selection signals for controlling distribution of the first data signals to the signal lines in the first signal line group; a second supply circuit that supplies the second data signals to the signal distribution circuit and supplies second selection signals for controlling distribution of the second data signals to the signal lines in the second signal line group; and a selection circuit that controls output of the first selection signals and the second selection signals to the signal distribution circuit.

In the electrooptical device according to the aspect, preferably, the first signal line group, the second signal line group, and the signal distribution circuit are provided in an electrooptical panel, the first supply circuit and the selection circuit are provided in a first generation circuit connected to the electrooptical panel via a first flexible printed circuit board, and the second supply circuit and the selection circuit are provided in a second generation circuit connected to the electrooptical panel via a second flexible printed circuit board.

In the electrooptical device according to the aspect, preferably, the first supply circuit generates the first data signals and the first selection signals, and the second supply circuit generates the second data signals and the second selection signals.

In the electrooptical device according to the aspect, preferably, the first flexible printed circuit board and the second flexible printed circuit board are partially stacked and connected to one side of the electrooptical panel.

In the electrooptical device according to the aspect, preferably, the first flexible printed circuit board is connected to one side of the electrooptical panel and the second flexible printed circuit board is connected to the other side opposite to the one side of the electrooptical panel.

An electrooptical device according to another aspect of the invention includes: a plurality of pixels that are disposed corresponding to the respective intersections between 2K (K is a natural number of two or more) or more signal lines and two or more scanning lines, and that display gradation according to signals supplied to the signal lines when the scanning lines are selected; a scanning line driving circuit that sequentially selects the respective two or more scanning lines; a first generation circuit that generates first data signals and a plurality of first selection signals, the first data signals for supplying the signals to the respective signal lines in a first signal line group with K signal lines; a second generation circuit that generates second data signals and second selection signals corresponding to the first selection signals for each of the first selection signals, the second data signals for supplying the signals to the respective signal lines in a second signal line group with K signal lines different from the K signal lines belonging to the first signal line group; and a signal distribution circuit that executes a distribution operation of distributing the first data signals to the respective signal lines in the first signal line group, and distributing the second data signals to the respective signal lines in the second signal line group, in which, the first generation circuit, in a first period, outputs, among the plurality of first selection signals, zero or more first selection signals, and in a second period, outputs the first selection signals which are not output in the first period among the plurality of first selection signals, in which, the second generation circuit, in the first period, outputs, among the plurality of second selection signals, the second selection signals corresponding to the first selection signals which are not output in the first period by the first generation circuit, and in the second period, outputs the second selection signals which are not output in the first period among the plurality of second selection signals, and in which, the signal distribution circuit, in the first period, executes the distribution operation using the selection signals which are output in the first period among the plurality of first selection signals and the plurality of second selection signals, and in the second period, executes the distribution operation using the selection signals which are output in the second period among the plurality of first selection signals and the plurality of second selection signals.

According to this aspect, among the plurality of first selection signals generated by the first generation circuit and the plurality of second selection signals generated by the second generation circuit, for each pair of the first selection signals and the second selection signals that correspond to each other, in the first period, among the first selection signals and the second selection signals, the selection signals on one side are output, and in the second period, the selection signals on the other side are output. The first data signals and the second data signals are distributed using the output result.

That is, in the total period of the first period and the second period, both of the first selection signals and the second selection signals are used. Therefore, as compared with the case where only one of the first selection signals generated by the first generation circuit and the second selection signals generated by the second generation circuit are used, a difference in the operation condition between the first generation circuit and the second generation circuit is reduced. Therefore, it is possible to suppress variations between the data signals due to the difference in the operation condition between the first generation circuit and the second generation circuit. Accordingly, it is possible to suppress deterioration in image quality due to variations between the data signals, and thus it is possible to improve image quality.

In addition, the signal distribution circuit does not simultaneously use the first selection signals and the second selection signals that correspond to each other, and in the first period and the second period, among the first selection signals and the second selection signals that correspond to each other, the selection signals on one side are used. Thus, it is possible to suppress deterioration in image quality due to the phase difference between the first selection signals and the second selection signals, which occurs in a case where the first selection signals and the second selection signals that correspond to each other are used at the same time.

The electrooptical device means a device including an electrooptical material of which the optical properties change by electrical energy. As the electrooptical material, a liquid crystal, an organic electro-luminescence (EL) material, or the like may be used.

In the electrooptical device according to the aspect, preferably, the first generation circuit outputs, in the first period, the plurality of first selection signals.

According to this aspect, the selection signals to be switched for each period are set according to the supply source of the selection signals. Therefore, selection of the selection signals for each period can be easily set.

In the electrooptical device according to the aspect, preferably, the first generation circuit outputs, in the first period, a portion of the plurality of first selection signals.

According to this aspect, in each of the first period and the second period, a portion of the first selection signals from the first generation circuit and a portion of the second selection signals from the second generation circuit are used. Thus, in each period, a difference in the operation condition between the first generation circuit and the second generation circuit can be reduced. Therefore, in each period, it is possible to suppress deterioration in image quality due to the difference in the operation condition between the first generation circuit and the second generation circuit.

In the electrooptical device according to the aspect, preferably, the first period and the second period are periods of one or more frames, and the first period and the second period are alternately repeated.

According to this aspect, switching between the first selection signals and the second selection signals is performed in a unit of a period of one or more frames. Thus, for example, switching can be performed using a signal that defines a frame period (for example, a vertical synchronization signal).

In the electrooptical device according to the aspect, preferably, the polarity of the first data signals and the polarity of the second data signals are inverted in a frame unit, and the first period and the second period are periods of two frames.

According to this aspect, the polarity of the first data signals and the polarity of the second data signals are inverted in a frame unit, and the first period and the second period are periods of two frames. Thus, it is possible to further suppress deterioration in image quality while canceling a difference in polarity between the frames within each period.

In the electrooptical device according to the aspect, preferably, the first period and the second period are periods of one or more lines, and the first period and the second period are alternately repeated.

According to this aspect, switching between the first selection signals and the second selection signals is performed within one frame. Thus, it is possible to make deterioration in image quality inconspicuous.

In the electrooptical device according to the aspect, preferably, a plurality of first signal line groups and a plurality of second signal line groups are present, and the first signal line group and the second signal line group are alternately disposed.

According to this aspect, it is possible to alternately dispose the pixel groups driven by the data signals from the different generation circuits. Therefore, it is possible to make a difference in image quality between the pixel groups driven by the data signals from the different generation circuits inconspicuous.

In the electrooptical device according to the aspect, preferably, the first generation circuit is connected to the first signal line groups via first data lines for each of the first signal line groups, the second generation circuit is connected to the second signal line groups via second data lines for each of the second signal line groups, and the first generation circuit is connected to the first data lines via a connection terminal and the second generation circuit is connected to the second data lines via a connection terminal such that the first data lines and the second data lines are alternately disposed side by side.

According to this aspect, the pitch between the data lines including the first data lines and the second data lines can be narrower than the pitch between only the first data lines or the pitch between only the second data lines. In addition, it becomes easier to alternately dispose the pixel group to which the first data signals are supplied and the pixel group to which the second data signals are supplied. In this case, it is possible to make a difference in image quality between the pixel groups inconspicuous.

In the electrooptical device according to the aspect, preferably, the first generation circuit outputs, in the first period, the plurality of first selection signals.

In the electrooptical device according to the aspect, preferably, the first generation circuit outputs, in the first period, a portion of the plurality of first selection signals.

In the electrooptical device according to the aspect, preferably, the first period and the second period are periods of one or more frames, and the first period and the second period are alternately repeated.

In the electrooptical device according to the aspect, preferably, the polarity of the first data signals and the polarity of the second data signals are inverted in a frame unit, and the first period and the second period are periods of two frames.

In the electrooptical device according to the aspect, preferably, the first period and the second period are periods of one or more lines, and the first period and the second period are alternately repeated.

A method for controlling an electrooptical device according to still another aspect of the invention is a method for controlling an electrooptical device including a plurality of pixels that are disposed corresponding to the respective intersections between 2K (K is a natural number of two or more) or more signal lines and two or more scanning lines, and that display gradation according to signals supplied to the signal lines when the scanning lines are selected. The method includes: selecting sequentially each of the two or more scanning lines; generating, by a first generation circuit, first data signals and a plurality of first selection signals, the first data signals for supplying the signals to the respective signal lines in a first signal line group with K signal lines; generating, by a second generation circuit, second data signals and second selection signals corresponding to the first selection signals for each of the first selection signals, the second data signals for supplying the signals to the respective signal lines in a second signal line group with K signal lines different from the K signal lines belonging to the first signal line group; executing, in a first period, by outputting, among the plurality of first selection signals, zero or more first selection signals, and outputting, among the plurality of second selection signals, the second selection signals corresponding to the first selection signals which are not output in the first period, a distribution operation of distributing the first data signals to the respective signal lines in the first signal line group and distributing the second data signals to the respective signal lines in the second signal line group, using the selection signals which are output in the first period among the plurality of first selection signals and the plurality of second selection signals; and executing, in a second period, by outputting, among the plurality of first selection signals, the first selection signals which are not output in the first period, and outputting, among the plurality of second selection signals, the second selection signals which are not output in the first period, the distribution operation using the selection signals which are output in the second period among the plurality of first selection signals and the plurality of second selection signals.

According to this aspect, in an average time of the total period including the first period and the second period, both of the first selection signals and the second selection signals are used, and a difference in the operation condition between the first generation circuit and the second generation circuit is reduced. Therefore, it is possible to suppress deterioration in image quality due to the difference in the operation condition between the first generation circuit and the second generation circuit.

An electronic apparatus according to still another aspect of the invention includes the above-described electrooptical device. The electrooptical device can prevent deterioration in image quality.

BRIEF DESCRIPTION OF THE DRAWINGS

The invention will be described with reference to the accompanying drawings, wherein like numbers reference like elements.

FIG. 7 is a diagram illustrating a relationship between an output value and an output of a signal selection circuit.

FIG. 9 is a diagram illustrating a relationship between an output value and an output of a signal selection circuit.

DESCRIPTION OF EXEMPLARY EMBODIMENTS

First Embodiment

Figure 1:
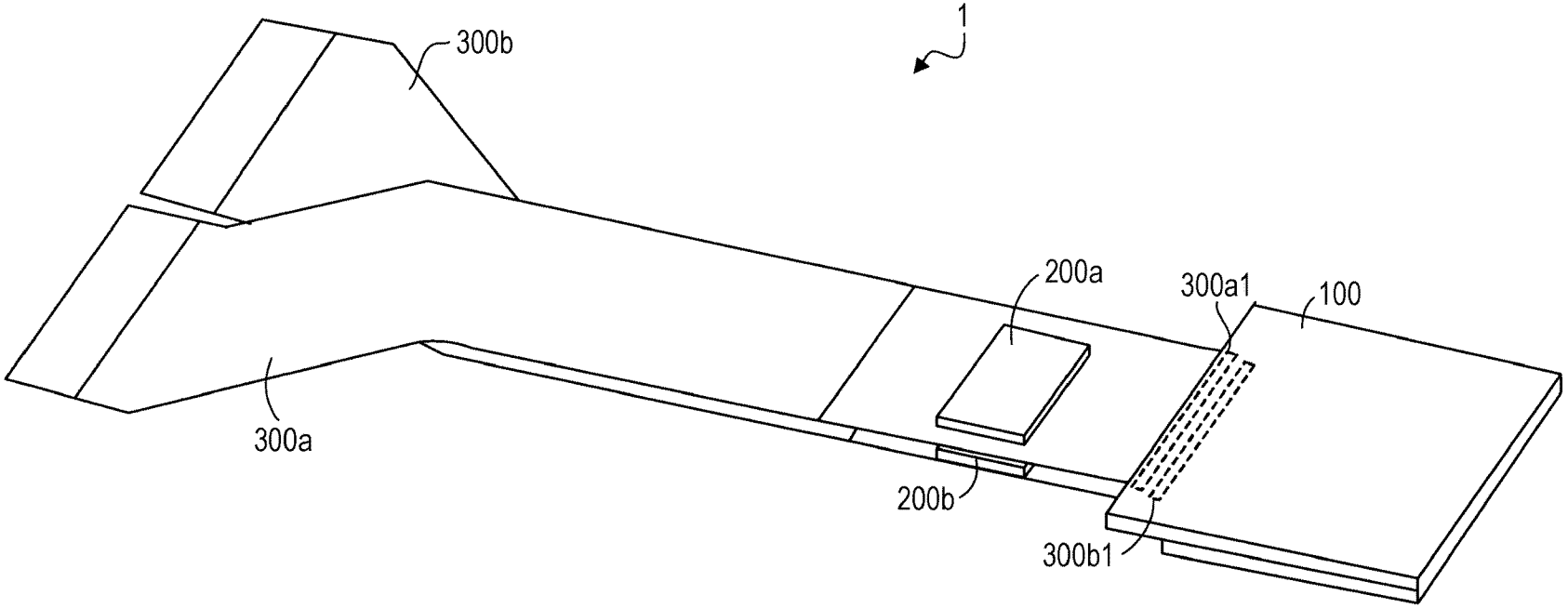
FIG. 1 is a diagram illustrating a configuration of a signal transmission system of an electrooptical device according to a first embodiment of the invention.

FIG. 1 is a diagram illustrating a configuration of a signal transmission system of an electrooptical device 1 according to a first embodiment of the invention. The electrooptical device 1 includes an electrooptical panel 100, a first generation circuit 200*a*, a second generation circuit 200*b*, flexible printed circuit boards 300*a* and 300*b*. The electrooptical device 1 may be, for example, a device which has the number of pixels of 3840×2160 obtained by respectively doubling the number of pixels of full hi-vision in the vertical direction and the horizontal direction. Each of the first generation circuit 200*a* and the second generation circuit 200*b* is, for example, a driving integrated circuit.

The first generation circuit 200*a* and the second generation circuit 200*b* are respectively mounted on the flexible printed circuit boards 300*a* and 300*b*. This configuration is called as chip on film (COF). In addition, in this example, the flexible printed circuit boards 300*a* and 300*b* are connected to the same positions along the one side of the electrooptical panel 100. The flexible printed circuit board 300*a* is stacked on the flexible printed circuit board 300*b*. The first generation circuit 200*a* is stacked on the second generation circuit 200*b*. The electrooptical panel 100 is connected to a connection terminal 300*a*1 of the flexible printed circuit board 300*a* and a connection terminal 300*b*1 of the flexible printed circuit board 300*b*. The electrooptical panel 100 is connected to a control circuit (not illustrated) via the flexible printed circuit board 300*a* and the first generation circuit 200*a* and via the flexible printed circuit board 300*b* and the second generation circuit 200*b*.

The first generation circuit 200*a* and the second generation circuit 200*b* respectively receive image signals $V_{ID}$ and various signals for driving control, from the control circuit via the flexible printed circuit boards 300*a* and 300*b*. The first generation circuit 200*a* and the second generation circuit 200*b* respectively drive the electrooptical panel 100 via the flexible printed circuit boards 300*a* and 300*b*.

Figure 2:
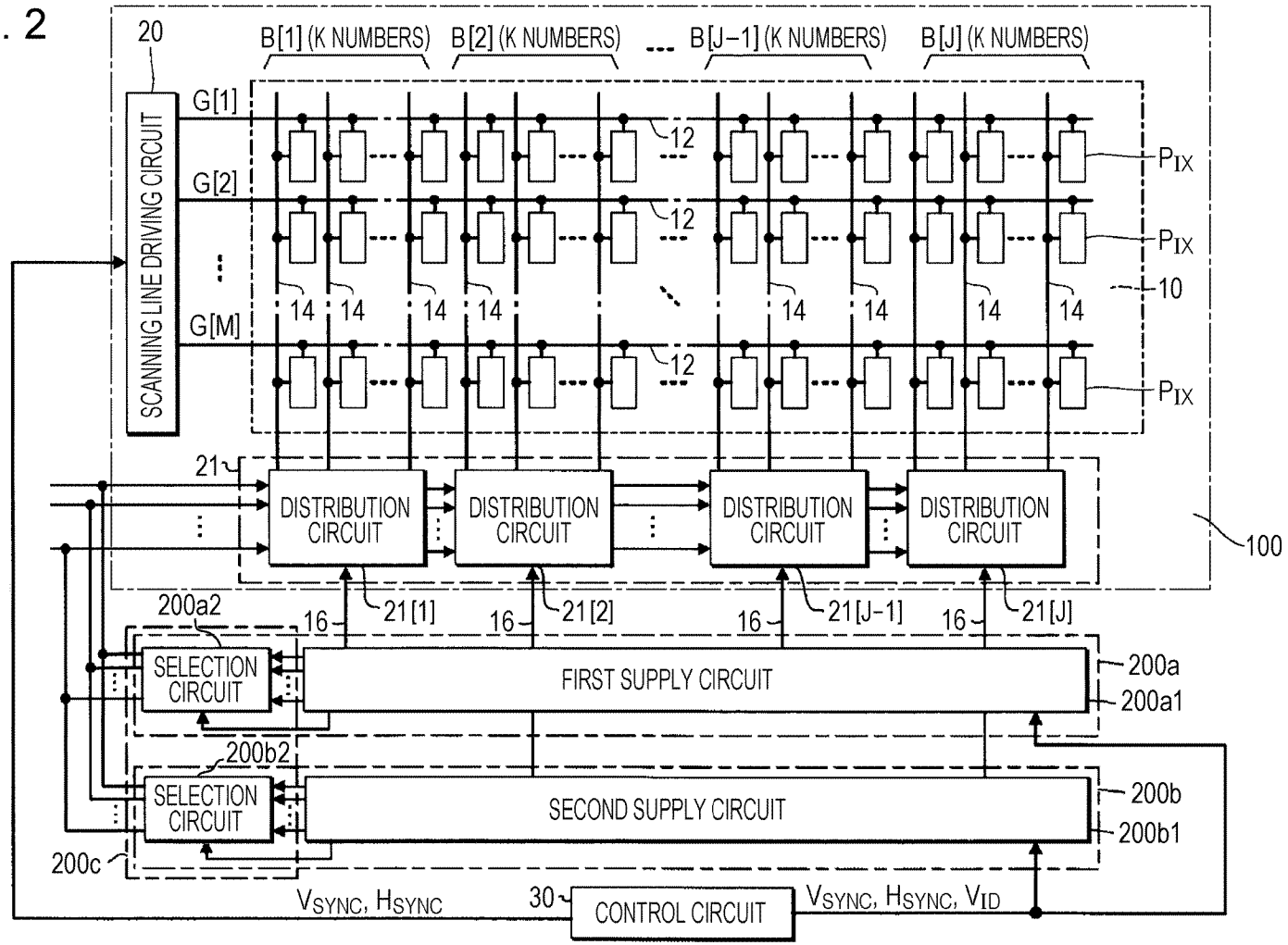
FIG. 2 is a block view illustrating a configuration of the electrooptical device.

FIG. 2 is a block diagram illustrating configurations of the electrooptical panel 100, the first generation circuit 200*a*, and the second generation circuit 200*b*.

The electrooptical panel 100 includes a pixel unit 10 in which a plurality of pixels $P_{IX}$ (pixel circuits) are arranged in a plane, a scanning line driving circuit 20, and a distribution circuit group 21. The distribution circuit group 21 is an example of a signal distribution circuit. The first generation circuit 200*a* includes a first supply circuit 200*a*1 and a selection circuit 200*a*2. The second generation circuit 200*b* includes a second supply circuit 200*b*1 and a selection circuit 200*b*2. The selection circuits 200*a*2 and 200*b*2 are included in a signal selection circuit 200*c*.

In the pixel unit 10, M scanning lines 12 and N signal lines 14 that intersect with each other are formed (M is a natural number of two or more, and N is a number of 2K or more (K is a natural number of two or more)). The plurality of pixels $P_{IX}$ are disposed corresponding to the intersections between the respective scanning lines 12 and the respective signal lines 14. Therefore, the plurality of pixels $P_{IX}$ are arranged in a matrix shape of M rows in the longitudinal direction×N columns in the transverse direction. The plurality of pixels $P_{IX}$ display the gradation according to the potential of the signal lines 14 when the scanning lines 12 are selected.

Although the entire area of the pixel unit 10 may be used as a display effective area, a part of the peripheral portion of the pixel unit 10 may be used as a non-display area, and the scanning lines 12, the signal lines 14, and the pixels $P_{IX}$ in the peripheral portion may be disposed as dummy scanning lines, dummy signal lines, and dummy pixels.

The N signal lines 14 in the pixel unit 10 are divided into J wiring groups (blocks) B[1] to B[J] (J=N/K) each with K signal lines 14 as a unit that are adjacent to each other. That is, the signal lines 14 are grouped for each wiring group block B. In the present embodiment, J is an even number of two or more. The odd-numbered wiring groups B[jodd] (jodd=1, 3, . . . , J−1) are an example of first signal line groups. The even-numbered wiring groups B[jeven] (jeven=2, 4, . . . , J) are an example of second signal line groups. Thus, the N signal lines 14 are included in the odd-numbered wiring groups B[jodd] (first signal line groups) and the even-numbered wiring groups B[jeven] (second signal line groups).

Figure 3:
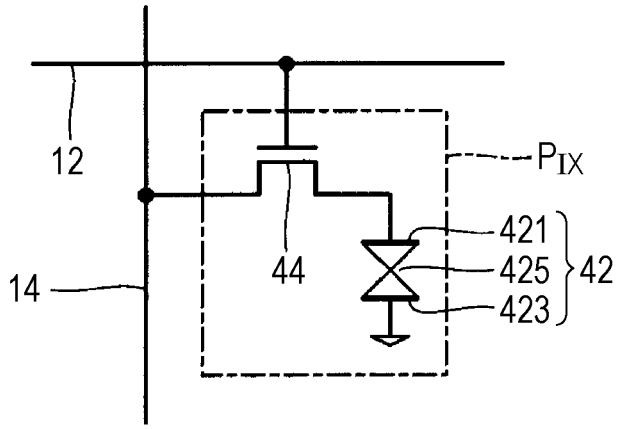
FIG. 3 is a circuit diagram of each pixel.

FIG. 3 is a circuit diagram of each pixel $P_{IX}$. Each pixel $P_{IX}$ is configured to include a liquid crystal element 42 and a selection switch 44. The liquid crystal element 42 is an example of an electrooptical element. The liquid crystal element 42 is configured with a pixel electrode 421 and a common electrode 423 that are opposed to each other, and a liquid crystal 425 interposed between both electrodes. The transmittance of the liquid crystal 425 changes according to the voltage applied between the pixel electrode 421 and the common electrode 423.

The selection switch 44 is configured with, for example, an N-channel type thin film transistor of which the gate is connected to the scanning line 12. The selection switch 44 is interposed between the liquid crystal element 42 (pixel electrode 421) and the signal line 14, and controls the electrical connection (conduction/non-conduction) between the liquid crystal element 42 and the signal line 14. The pixel $P_{IX}$ (liquid crystal element 42) displays the gradation according to the potential (gradation potential $V_G$ to be described later) of the signal line 14 when the selection switch 44 is controlled to be in a turned-on state. Auxiliary capacitors and the like connected in parallel to the liquid crystal element 42 are not illustrated. The configuration of the pixel $P_{IX}$ can be appropriately changed.

Figure 4:
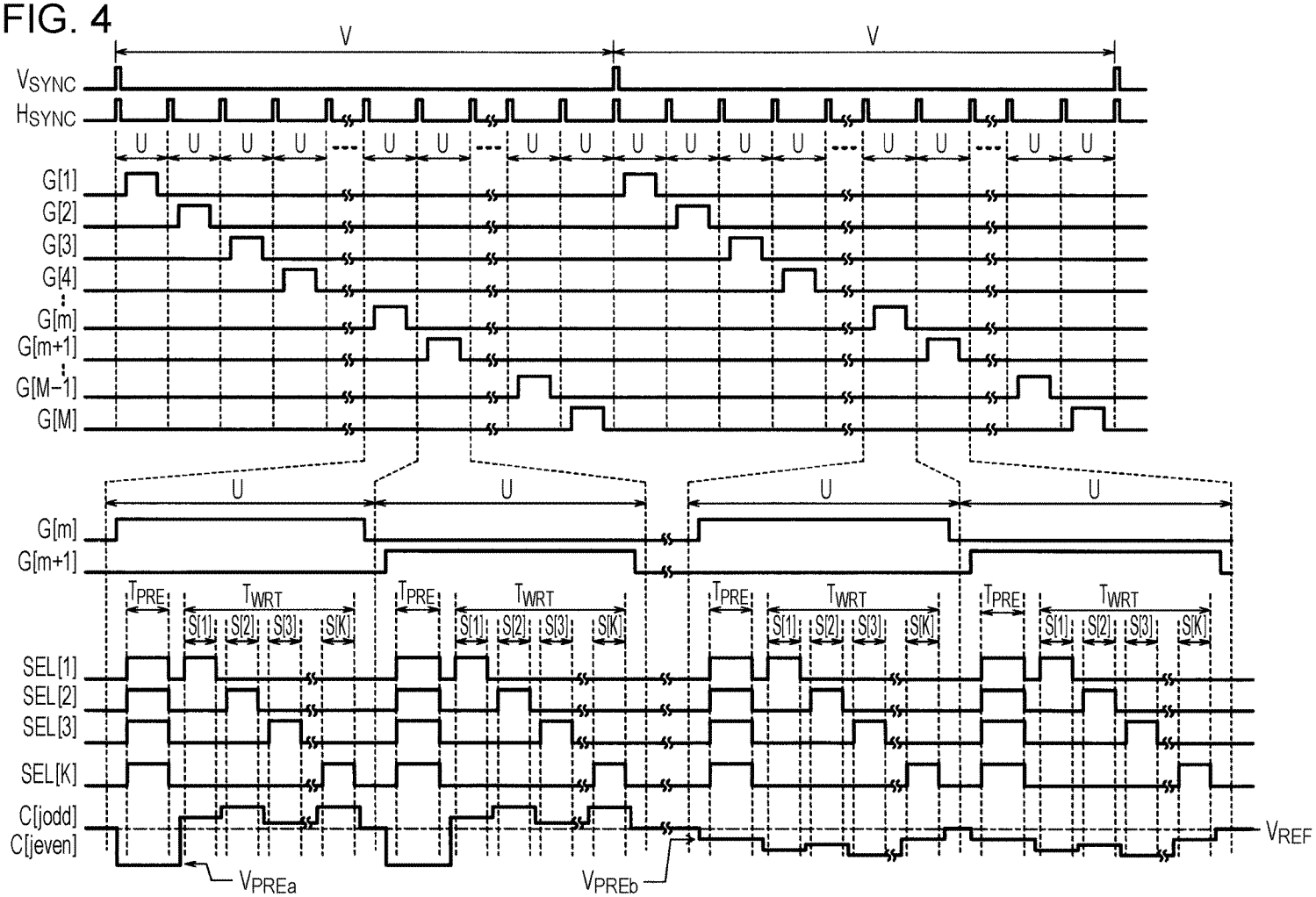
FIG. 4 is an explanatory diagram of an operation of the electrooptical device.

Returning to FIG. 2, the control circuit 30 controls the scanning line driving circuit 20, the first supply circuit 200*a*1, and the second supply circuit 200*b*1 by using various signals including a synchronization signal. For example, the control circuit 30 supplies a vertical synchronization signal $V_{SYNC}$ that defines a vertical scanning period V and a horizontal synchronization signal $H_{SYNC}$ that defines a horizontal scanning period, as illustrated in FIG. 4, to the scanning line driving circuit 20, the first supply circuit 200*a*1, and the second supply circuit 200*b*1. Further, the control circuit 30 supplies image signals $V_{ID}$ for designating the gradation of each pixel $P_{IX}$ in a time-division manner, to the first supply circuit 200*a*1 and the second supply circuit 200*b*1. The scanning line driving circuit 20, the first supply circuit 200*a*1, and the second supply circuit 200*b*1 cooperate with each other to control the display of the pixel unit 10.

Typically, display data constituting one display screen is processed in a frame unit, and the processing period is one frame period (1F). The frame period F corresponds to the vertical scanning period V in a case where one display screen is formed by one vertical scanning.

As illustrated in FIG. 4, the scanning line driving circuit 20 sequentially selects the respective M scanning lines 12 according to the horizontal synchronization signal $H_{SYNC}$, by sequentially outputting the scanning signals G[1] to G[M] to the respective M scanning lines 12 for each unit period U. The unit period U is set to the time length of one cycle of the horizontal synchronization signal $H_{SYNC}$ (horizontal scanning period (1H)).

As illustrated in FIG. 4, the scanning signal G[m] supplied to the scanning line 12 of the m-th row (m-th line) (m is a natural number of one or more and M or less) is set to the high level (potential indicating selection of the scanning line 12) in the m-th unit period U among the M unit periods U of each vertical scanning period V. The period for which the scanning line 12 is selected is also called a line period, and in this embodiment, substantially corresponds to the unit period U.

When the scanning line driving circuit 20 selects the scanning line 12 of the m-th row, the respective selection switches 44 of the N pixels $P_{IX}$ of the m-th row transition to the turned-on state.

As illustrated in FIG. 4, the unit period U includes a precharge period $T_{PRE}$ and a write period $T_{WRT}$.

The precharge period $T_{PRE}$ is set before the start of the write period $T_{WRT}$. In FIG. 4, although one precharge period $T_{PRE}$ is provided before the write period $T_{WRT}$, a plurality (for example, two) of precharge periods $T_{PRE}$ may be provided before the write period $T_{WRT}$.

In the write period $T_{WRT}$, the gradation potential $V_G$ according to the designated gradation of each pixel $P_{IX}$ is supplied to the respective signal line 14. In the precharge period $T_{PRE}$, predetermined precharge potential $V_{PRE}$ ($V_{PREa}$, $V_{PREb}$) is supplied to the respective signal line 14.

The distribution circuit group 21 includes J distribution circuits 21[1] to 21[J]. The distribution circuits 21[1] to 21[J] respectively correspond to the wiring groups B[1] to B[J]. In this embodiment, a demultiplexer is used as each of the distribution circuits 21[1] to 21[J].

Figure 5:
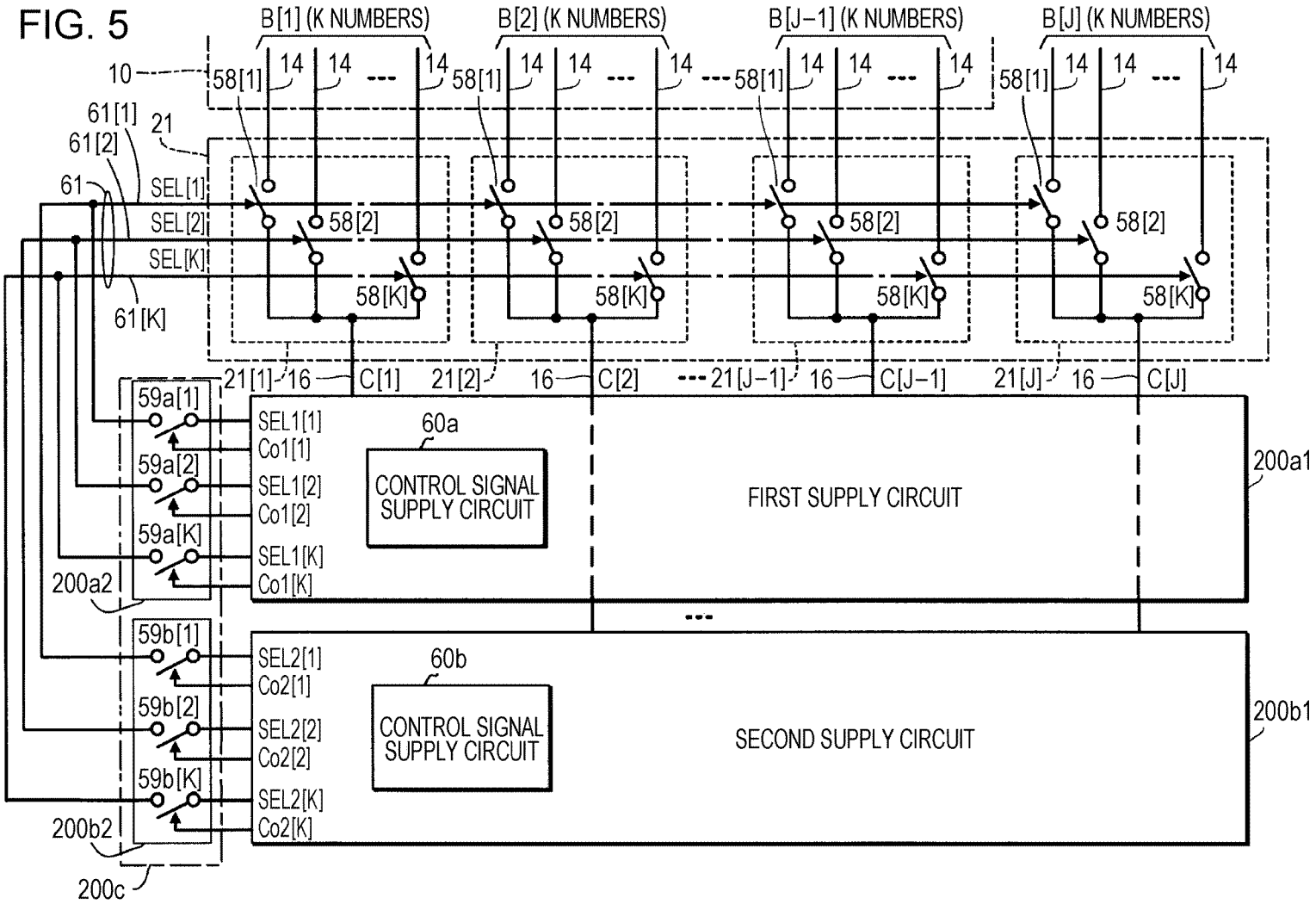
FIG. 5 is a block view illustrating a configuration of a part of the electrooptical device.

FIG. 5 is a diagram illustrating an example of the distribution circuit group 21, the signal selection circuit 200*c*, the first supply circuit 200*a*1, and the second supply circuit 200*b*1.

The j-th (j is a natural number of one or more and J or less) distribution circuit 21[*j*] is configured to include K switches 58[1] to 58[K] corresponding to the K signal lines 14 of the j-th wiring group B[j].

The k-th (k is a natural number of one or more and K or less) switch 58[*k*] in the distribution circuit 21[*j*] is interposed between the signal line 14 of the k-th column among the K signal lines 14 of the wiring group B[j] and the j-th data line 16 among the J data lines 16, and controls the electrical connection (conduction/non-conduction) between the k-th signal line 14 and the j-th data line 16.

The odd-numbered data lines 16 connect the first supply circuit 200*a*1 and the odd-numbered distribution circuits 21[jodd]. The odd-numbered data lines 16 are an example of first data lines. The even-numbered data lines 16 connect the second supply circuit 200*b*1 and the even-numbered distribution circuits 21[jeven]. The even-numbered data lines 16 are an example of second data lines.

The distribution circuits 21[*j*] are connected to the signal selection circuit 200*c* via a selection signal line group 61 including K selection signal lines 61[1] to 61[K].

The selection signal lines 61[1] to 61[K] are respectively connected to the selection circuits 200*a*2 and 200*b*2.

The first supply circuit 200*a*1 supplies data signals C[jodd] including, in a time-division manner, potential to be supplied to the respective signal lines 14 in the wiring groups B[jodd] (first signal line groups), to the distribution circuits 21[jodd] via the jodd-th data lines 16. The potential is an example of a signal. The jodd-th data lines 16 are an example of first data lines. The first supply circuit 200*a*1 respectively supplies the data signals C[jodd] in parallel. The data signals C[jodd] are an example of first data signals.

The second supply circuit 200*b*1 supplies the data signals C[jeven] including, in a time-division manner, potential to be supplied to the respective signal lines 14 in the wiring groups B[jeven] (second signal line groups), to the distribution circuits 21[jeven] via the jeven-th data lines 16. The jeven-th data lines 16 are an example of second data lines. The second supply circuit 200*b*1 respectively supplies the data signals C[jeven] in parallel. The data signals C[jeven] are an example of second data signals.

In this way, since the first supply circuit 200*a*1 drives the odd-numbered wiring groups B[jodd] and the second supply circuit 200*b*1 drives the even-numbered wiring groups B[jeven], the pitch between the data lines 16 can be narrowed. As a result, a high-definition image can be displayed.

The first supply circuit 200*a*1 outputs K first selection signals SEL1[1] to SEL1[K] for distributing the data signals C[j] to the respective signal lines 14 in the wiring groups B[j], to the selection circuit 200*a*2. The first supply circuit 200*a*1 (first generation circuit 200*a*) generates and outputs the K first selection signals.

The second supply circuit 200*b*1 outputs K second selection signals SEL2[1] to SEL2[K] for distributing the data signals C[j] to the respective signal lines 14 in the wiring groups B[j], to the selection circuit 200*b*2. The second supply circuit 200*b*1 (second generation circuit 200*b*) generates and outputs the K second selection signals corresponding to the K first selection signals one to one.

The first selection signals SEL1[*k*] and the second selection signals SEL2[*k*] correspond to each other. For example, the second selection signal SEL2[1] corresponds to the first selection signal SEL1[1], and the second selection signal SEL2[K] corresponds to the first selection signal SEL1[K].

The first supply circuit 200*a*1 outputs first control signals Co1[1] to Co1[K] for controlling output of each of the first selection signals SEL1[1] to SEL1[K] from the selection circuit 200*a*2, to the selection circuit 200*a*2. The first control signals Co1[1] to Co1[K] are supplied by a control signal supply circuit 60*a* in the first supply circuit 200*a*1.

The second supply circuit 200*b*1 outputs second control signals Co2[1] to Co2[K] for controlling output of each of the second selection signals SEL2[1] to SEL2[K] from the selection circuit 200*b*2, to the selection circuit 200*b*2. The second control signals Co2[1] to Co2[K] are supplied by a control signal supply circuit 60*b* in the second supply circuit 200*b*1.

Figure 6:
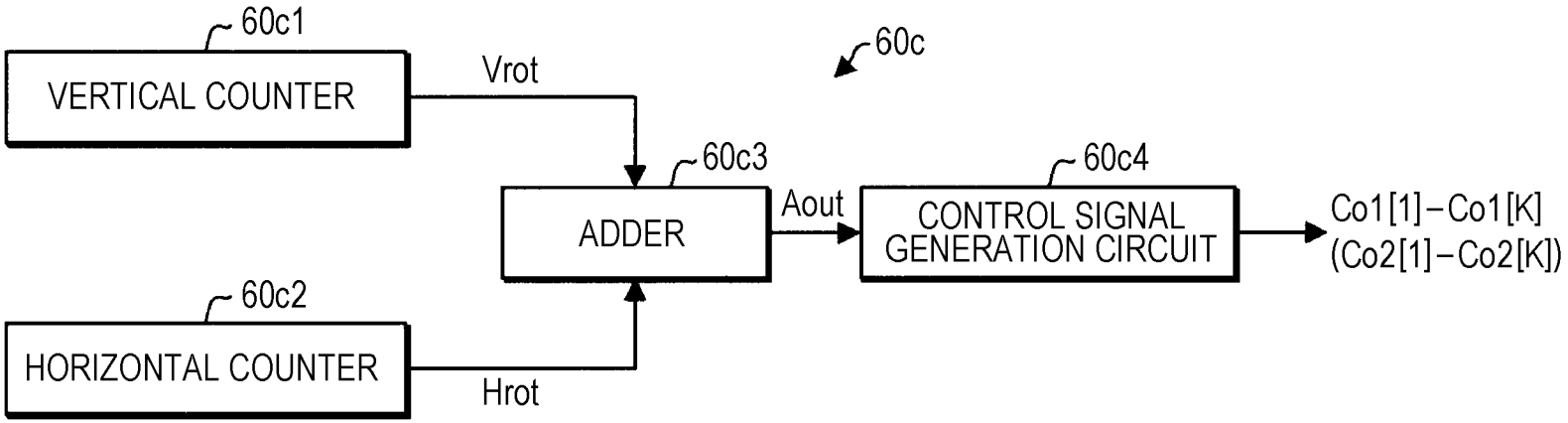
FIG. 6 is a diagram illustrating an example of a control signal supply circuit.

FIG. 6 is a diagram illustrating an example of a control signal supply circuit 60*c* which can be used as the control signal supply circuit 60*a* of the first supply circuit 200*a*1 or the control signal supply circuit 60*b* of the second supply circuit 200*b*1.

The control signal supply circuit 60*c* includes a vertical counter 60*c*1, a horizontal counter 60*c*2, an adder 60*c*3, and a control signal generation circuit 60*c*4. The vertical counter 60*c*1 counts the vertical synchronization signal $V_{SYNC}$. The horizontal counter 60*c*2 counts the horizontal synchronization signal $H_{SYNC}$. The adder 60*c*3 adds a count value $V_{rot}$ of the vertical counter 60*c*1 and a count value $H_{rot}$ of the horizontal counter 60*c*2. The control signal generation circuit 60*c*4 generates the control signals Co[1] to Co[K] according to an output value $A_{out}$ of the adder 60*c*3. For example, in the control signal generation circuit 60*c*4, outputs of the control signals Co[1] to Co[K] are set in advance according to the output value $A_{out}$.

In a case where the control signal supply circuit 60*c* is used as the control signal supply circuit 60*a*, the control signals Co[1] to Co[K] are used as the first control signals Co1[1] to Co1[K]. On the other hand, in a case where the control signal supply circuit 60*c* is used as the control signal supply circuit 60*b*, the control signals Co[1] to Co[K] are used as the second control signals Co2[1] to Co2[K].

In the case where the control signal supply circuit 60*c* is used as the control signal supply circuit 60*a* of the first supply circuit 200*a*1, and in the case where the control signal supply circuit 60*c* is used as the control signal supply circuit 60*b* of the second supply circuit 200*b*1, for each case, in the control signal generation circuit 60*c*4, a relationship between the output value $A_{out}$ and the control signals Co[1] to Co[K] is set to be different. Therefore, for each case, in the control signal generation circuit 60*c*4, different control signals Co[1] to Co[K] are generated for the same output value $A_{out}$.

In each case, for each pair (set) of the first selection signals SEL1[*k*] and the second selection signals SEL2[*k*] that correspond to each other, when the output value $A_{out}=1$, the control signal generation circuit 60*c*4 generates the first control signals Co1[*k*] and the second control signals Co2[*k*] such that the selection signals on one side constituting the pair are selected. In addition, in each case, for each pair of the first selection signals SEL1[*k*] and the second selection signals SEL2[*k*], when the output value $A_{out}=0$, the control signal generation circuit 60*c*4 generates the first control signals Co1[k] and the second control signals Co2[k] such that the selection signals on the other side constituting the pair are selected.

For example, the control signal generation circuit 60c4 generates the first control signals Co1[1] to Co1[K] and the second control signals Co2[1] to Co2[K] such that the signal selection circuit 200c outputs, in a first period, only the first selection signals SEL1[1] to SEL1[K] and outputs, in a second period, only the second selection signals SEL2[1] to SEL2[K]. The first period and the second period are periods which are defined based on the vertical synchronization signal $V_{SYNC}$ and the horizontal synchronization signal $H_{SYNC}$.

Returning to FIG. 5, for each pair of the first selection signals SEL1[k] and the second selection signals SEL2[k], in the first period, the signal selection circuit 200c selects and outputs one side of the first selection signals SEL1[k] and the second selection signals SEL2[k] that constitute the pair. In addition, for each pair, in the second period, the signal selection circuit 200c selects and outputs the other side of the first selection signals SEL1[k] and the second selection signals SEL2[k] that constitute the pair.

As illustrated in FIG. 5, the selection circuit 200a2 is configured to include K switches 59a[1] to 59a[K] corresponding to each of the K first selection signals SEL1[1] to SEL1[K] and each of the K first control signals Co1[1] to Co1[K]. The corresponding first selection signals SEL1[k] are input to the switches 59a[k]. The switches 59a[k] are turned on/off by the corresponding first control signals Co1[k]. The switches 59a[1] to 59a[K] may be physical switches or tri-state buffers capable of switching between a conductive state (corresponding to a turned-on state) and a high impedance state (corresponding to a turned-off state).

Since the switches 59a[1] to 59a[K] are respectively turned on/off based on the first control signals Co1[1] to Co1[K], among the first selection signals SEL1[1] to SEL1[K], the first selection signals SEL1 to be supplied to the distribution circuit group 21 are selected.

As illustrated in FIG. 5, the selection circuit 200b2 is configured to include K switches 59b[1] to 59b[K] corresponding to each of the K second selection signals SEL2[1] to SEL2[K] and each of the K second control signals Co2[1] to Co2[K]. The corresponding second selection signals SEL2[k] are input to the switches 59b[k]. The switches 59b[k] are turned on/off by the corresponding second control signals Co2[k]. Similarly to the switches 59a[1] to 59a[K], the switches 59b[1] to 59b[K] may be physical switches or tri-state buffers capable of switching between a conductive state and a high impedance state.

Since the switches 59b[1] to 59b[K] are respectively turned on/off based on the second control signals Co2[1] to Co2[K], among the second selection signals SEL2[1] to SEL2[K], the second selection signals SEL2 to be supplied to the distribution circuit group 21 are selected.

The distribution circuits 21[jodd] included in the distribution circuit group 21 distribute the data signals C[jodd] to the respective K signal lines 14 in the wiring groups B[jodd], by using the selection result of the signal selection circuit 200c. The distribution circuits 21[jeven] included in the distribution circuit group 21 distribute the data signals C[jeven] to the respective K signal lines 14 in the wiring groups B[jeven], by using the selection result of the signal selection circuit 200c.

Outline of Operation

Next, an outline of the operation of the electrooptical device 1 will be described.

The first generation circuit 200a generates the data signals C[jodd] (first data signals) that designate, in a time-division manner, the gradation of the pixels $P_{IX}$ corresponding to the respective signal lines 14 in the wiring groups B[jodd]. The second generation circuit 200b generates the data signals C[jeven] (second data signals) that designate, in a time-division manner, the gradation of the pixels $P_{IX}$ corresponding to the respective signal lines 14 in the wiring groups B[jeven].

The first generation circuit 200a further generates the first selection signals SEL1[1] to SEL1[K]. The second generation circuit 200b further generates the second selection signals SEL2[1] to SEL2[K] corresponding to the first selection signals SEL1[1] to SEL1[K] one to one.

In the first period, the first generation circuit 200a outputs zero or more first selection signals SEL1 among the first selection signals SEL1[1] to SEL1[K], and in the second period, outputs the first selection signals SEL1 which are not output in the first period among the first selection signals SEL1[1] to SEL1[K].

In the first period, the second generation circuit 200b outputs, among the second selection signals SEL2[1] to SEL2[K], the second selection signals SEL2 corresponding to the first selection signals SEL1 that are not output in the first period by the first generation circuit 200a, and in the second period, outputs the second selection signals SEL2 which are not output in the first period among the second selection signals SEL2[1] to SEL2[K].

In the first period, the distribution circuit group 21 executes a distribution operation for distributing the data signals C[jodd] to the respective signal lines 14 in the wiring groups B[jodd], and distributing the data signals C[jeven] to the respective signal lines 14 in the wiring groups B[jeven], by using the selection signals which are output in the first period among the first selection signals SEL1[1] to SEL1[K] and the second selection signals SEL2[1] to SEL2[K]. In addition, in the second period, the distribution circuit group 21 executes the above-described distribution operation, by using the selection signals which are output in the second period among the first selection signals SEL1[1] to SEL1[K] and the second selection signals SEL2[1] to SEL2[K].

According to the present embodiment, in an average time of the total period of the first period and the second period, both of the first selection signals SEL1[k] and the second selection signals SEL2[k] that correspond to each other are used, and a difference in the operation condition between the first generation circuit 200a and the second generation circuit 200b is reduced. Therefore, it is possible to suppress variations between the data signals C[jodd] and the data signals C[jeven] due to the difference in the operation condition between the first generation circuit 200a and the second generation circuit 200b, and thus it is possible to suppress deterioration in image quality.

In addition, although the distribution circuit group 21 may simultaneously use the first selection signals SEL1[k] and the second selection signals SEL2[k] that correspond to each other, in the present embodiment, the first selection signals SEL1[K] and the second selection signals SEL2[k] that correspond to each other are not used at the same time. Therefore, it is possible to suppress deterioration in image quality due to a difference in signal waveform such as a phase difference or a difference in timing between the first selection signals SEL1[k] and the second selection signals SEL2[k], the difference being generated when the first selection signals SEL1[k] and the second selection signals SEL2[k] that correspond to each other are simultaneously used.

Detailed Description of Operation

1. Selection Operation between First Selection Signals and Second Selection Signals First, a selection operation between the first selection signals and the second selection signals, more specifically, operations of the signal selection circuit 200*c* and the control signal supply circuits 60*a* and 60*b* will be described.

First, when K=8, an example of the vertical counter 60*c*1, the horizontal counter 60*c*2, the adder 60*c*3, and the control signal generation circuit 60*c*4 will be described. Here, K is not limited to 8, and may be an integer of two or more (for example, four). Each of the vertical counter 60*c*1 and the horizontal counter 60*c*2 is a one-bit cyclic counter. In addition, the adder 60*c*3 is a one-bit adder. In the following, the output value of the adder 60*c*3 is set as the output value $A_{out}$.

The period for which the output value $A_{out}$ is "0" is an example of the first period. The period for which the output value $A_{out}$ is "1" is an example of the second period. The period for which the output value $A_{out}$ is "0" may be an example of the second period, and the period for which the output value $A_{out}$ is "1" may be an example of the first period.

FIG. 7 is a diagram illustrating a setting example of a relationship between an output value $A_{out}$ and an output of a signal selection circuit 200*c*. In FIG. 7, the vertical direction corresponds to the rows (lines) of the scanning lines 12, the horizontal direction corresponds to frames, and n−1 frame to n+3 frame are illustrated.

In FIG. 7, when the output value $A_{out}$=0, it means that the signal selection circuit 200*c* outputs the first selection signals SEL1[1] to SEL1[8] from the first supply circuit 200*a*1 and does not output the second selection signals SEL2[1] to SEL2[8] from the second supply circuit 200*b*1.

Figure 8:
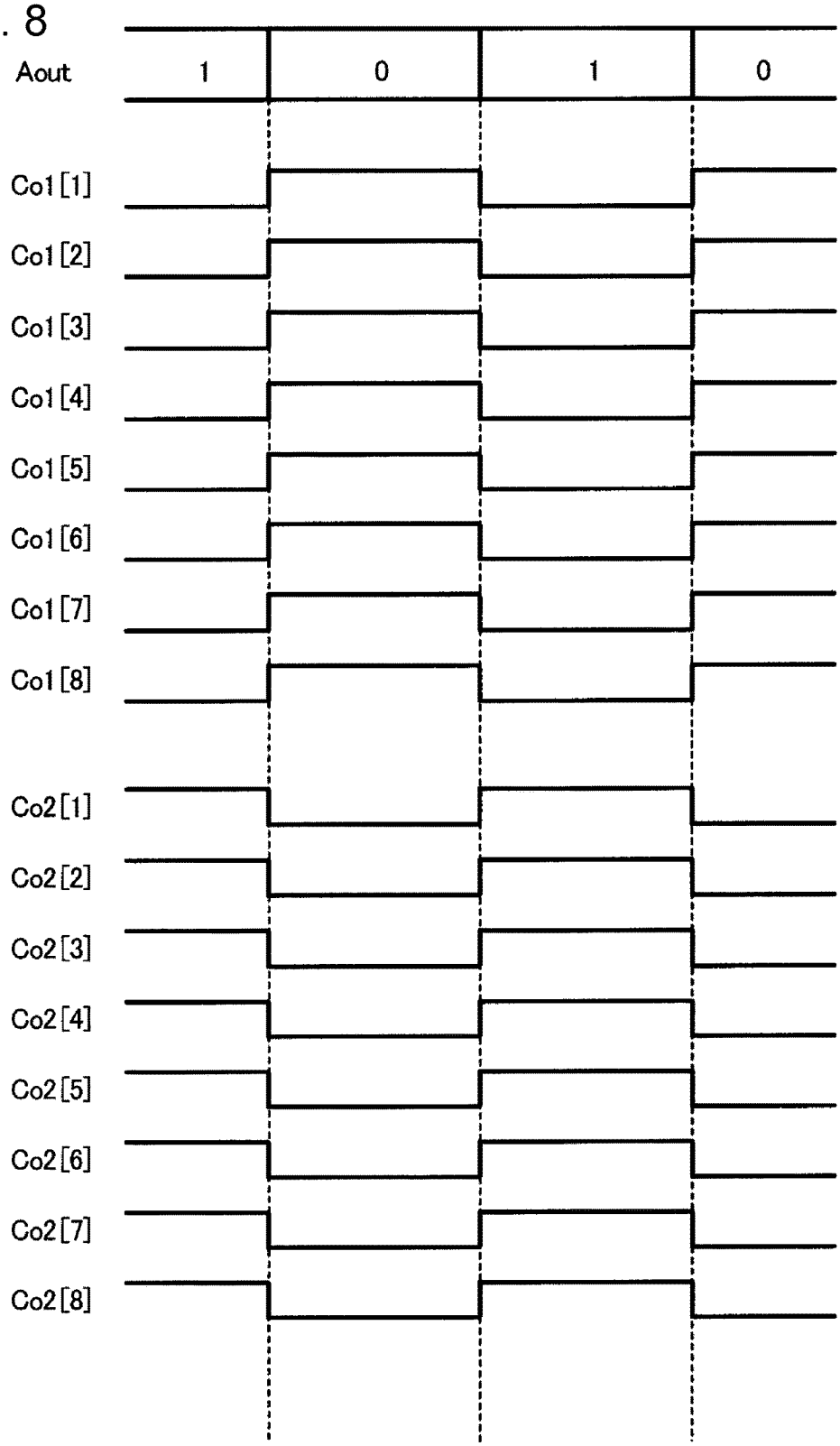
FIG. 8 is an explanatory diagram of outputs of a first control signal and a second control signal.

In this case, as illustrated in FIG. 8, when the output value $A_{out}$=0, each control signal generation circuit 60*c*4 in the control signal supply circuits 60*a* and 60*b* sets the first control signals Co1[1] to Co1[8] to an active level and sets the second control signals Co2[1] to Co2[8] to an inactive level. Therefore, when the output value $A_{out}$=0, the switches 59*a*[1] to 59*a*[8] in the selection circuit 200*a*2 come into the turned-on state (conductive state) and the switches 59*b*[1] to 59*b*[8] in the selection circuit 200*b*2 come into the turned-off state (high impedance state). Accordingly, when the output value $A_{out}$=0, the signal selection circuit 200*c* outputs the first selection signals SEL1[1] to SEL1[8] from the first supply circuit 200*a*1, and does not output the second selection signals SEL2[1] to SEL2[8] from the second supply circuit 200*b*1.

In addition, in FIG. 7, when the output value $A_{out}$=1, it means that the signal selection circuit 200*c* does not output the first selection signals SEL1[1] to SEL1[8] from the first supply circuit 200*a*1 and outputs the second selection signals SEL2[1] to SEL2[8] from the second supply circuit 200*b*1.

In this case, as illustrated in FIG. 8, when the output value $A_{out}$=1, each control signal generation circuit 60*c*4 in the control signal supply circuits 60*a* and 60*b* sets the first control signals Co1[1] to Co1[8] to an inactive level and sets the second control signals Co2[1] to Co2[8] to an active level. Therefore, when the output value $A_{out}$=1, the switches 59*a*[1] to 59*a*[8] in the selection circuit 200*a*2 come into the turned-off state (high impedance state) and the switches 59*b*[1] to 59*b*[8] in the selection circuit 200*b*2 come into the turned-on state (conductive state). Accordingly, when the output value $A_{out}$=1, the signal selection circuit 200*c* does not output the first selection signals SEL1[1] to SEL1[8] from the first supply circuit 200*a*1, and outputs the second selection signals SEL2[1] to SEL2[8] from the second supply circuit 200*b*1.

Thus, according to switching between "0" and "1" in the output value $A_{out}$, the signal selection circuit 200*c* switches the selection signals to be output to the selection signal lines 61[*k*] between the first selection signals SEL1[*k*] and the second selection signals SEL2[*k*]. Therefore, in an average time of the total period of the period for which the output value $A_{out}$ is "0" and the period for which the output value $A_{out}$ is "1", both of the first selection signals SEL1[*k*] and the second selection signals SEL2[*k*] are used, and a difference in the operation condition between the first supply circuit 200*a*1 and the second supply circuit 200*b*1 is reduced.

In addition, in this example, the selection signals to be output to the selection signal lines 61[*k*] are switched, for one line, between the first selection signals SEL1[*k*] and the second selection signals SEL2[*k*]. Further, the selection signals to be output to the selection signal lines 61[*k*] are switched, for one frame, between the first selection signals SEL1[*k*] and the second selection signals SEL2[*k*]. Accordingly, even when there is a variation in driving capability between the first supply circuit 200*a*1 and the second supply circuit 200*b*1, the variation is visually canceled, and thus it is possible to improve image quality.

In the above-described example, although the selection signals to be output to the selection signal lines 61[*k*] are switched, for one line, between the first selection signals SEL1[*k*] and the second selection signals SEL2[*k*], a unit of switching may be one or more line periods.

In addition, in the above-described example, although the selection signals to be output to the selection signal lines 61[*k*] are switched, for one frame, between the first selection signals SEL1[*k*] and the second selection signals SEL2[*k*], a unit of switching may be a period of one or more frames.

2. Precharge Operation

Next, a precharge operation will be described.

As illustrated in FIG. 4, in the precharge period $T_{PRE}$, the first supply circuit 200*a*1 sets the data signals C[jodd] to the precharge potential $V_{PRE}$ ($V_{PREa}$, $V_{PREb}$). The precharge potential $V_{PRE}$ is set to negative potential with respect to predetermined reference potential $V_{REF}$ (for example, potential corresponding to the center of the amplitude of the gradation potential $V_G$).

As illustrated in FIG. 4, in the precharge period $T_{PRE}$ immediately before the write period $T_{WRT}$ for which the gradation potential $V_G$ is set to positive potential with respect to the reference potential $V_{REF}$, the data signals C[jodd] are set to the precharge potential $V_{PREa}$. On the other hand, in the precharge period $T_{PRE}$ immediately before the write period $T_{WRT}$ for which the gradation potential $V_G$ is set to negative potential, the data signals C[jodd] are set to the precharge potential $V_{PREb}$. The precharge potential $V_{PREa}$ is set to potential lower than the precharge potential $V_{PREb}$ (potential greatly different from the reference potential $V_{REF}$).

During the precharge period $T_{PRE}$, the first supply circuit 200*a*1 simultaneously sets the first selection signals SEL1[1] to SEL1[8] to the active level (potential at which the switches 58[*k*] transition to the turned-on state) (refer to SEL[1] to SEL[K] in FIG. 4, K=8).

In addition, as illustrated in FIG. 4, in the precharge period $T_{PRE}$, the second supply circuit 200*b*1 sets the data signals C[jeven] to the precharge potential $V_{PRE}$ ($V_{PREa}$, $V_{PREb}$). Similarly to the data signals C[jodd], in the precharge period $T_{PRE}$ immediately before the write period $T_{WRT}$ for which the gradation potential $V_G$ is set to positive potential with respect to the reference potential $V_{REF}$, the data signals C[jeven] are set to the precharge potential $V_{PREa}$. On the other hand, similarly to the data signals C[jodd], in the precharge period $T_{PRE}$ immediately before the write period $T_{WRT}$ for which the gradation potential $V_G$ is set to negative potential, the data signals C[jeven] are set to the precharge potential $V_{PREb}$.

During the precharge period $T_{PRE}$, the second supply circuit 200*b*1 simultaneously sets the second selection signals SEL2[1] to SEL2[K] to the active level (refer to SEL[1] to SEL[K] in FIG. 4, K=8).

In a case where the output value $A_{out}$=0 in the precharge period $T_{PRE}$ (refer to FIG. 8, the first control signals Co1[1] to Co1[8] are in an active level and the second control signals Co2[1] to Co2[8] are in an inactive level), the signal selection circuit 200*c* outputs the first selection signals SEL1[1] to SEL1[8] to the selection signal lines 61[1] to 61[8], respectively. At this time, the signal selection circuit 200*c* does not output the second selection signals SEL2[1] to SEL2[8] to the selection signal lines 61[1] to 61[8].

On the other hand, in a case where the output value $A_{out}$=1 in the precharge period $T_{PRE}$ (refer to FIG. 8, the first control signals Co1[1] to Co1[8] are in an inactive level and the second control signals Co2[1] to Co2[8] are in an active level), the signal selection circuit 200*c* outputs the second selection signals SEL2[1] to SEL2[8] to the selection signal lines 61[1] to 61[8], respectively. At this time, the signal selection circuit 200*c* does not output the first selection signals SEL1[1] to SEL1[8] to the selection signal lines 61[1] to 61[8].

Therefore, in the precharge period $T_{PRE}$, all of the switches 58[*k*] in the distribution circuit group 21 transition to the turned-on state, and the precharge potential $V_{PRE}$ is supplied in parallel to each of the signal lines 14 (further, to the pixel electrode 421 in each pixel $P_{IX}$) connected to the distribution circuit group 21. Since the potential of the respective signal lines 14 is initialized to the precharge potential $V_{PRE}$ before supply (before writing) of the gradation potential $V_G$ to each pixel $P_{IX}$, it is necessary to prevent gradation unevenness (vertical crosstalk) of the display image.

3. Write Operation

Next, a write operation will be described.

During the write period $T_{WRT}$ within the selection period of the scanning line 12 of the m-th row, the first supply circuit 200*a*1 sets, in a time-division manner, the data signals C[jodd] to the gradation potential $V_G$ according to the designated gradation of the pixels $P_{IX}$ corresponding to the respective intersections between the scanning line 12 of the m-th row and the signal lines 14 in the wiring groups B[jodd]. The designated gradation of each pixel $P_{IX}$ is defined by the image signals $V_{ID}$ supplied from the control circuit 30. The polarity of the gradation potential $V_G$ with respect to the reference potential $V_{REF}$ is inverted periodically (for example, for a vertical scanning period V) and sequentially in order to prevent so-called ghosting.

Further, as illustrated in FIG. 4, during the write period $T_{WRT}$, the first supply circuit 200*a*1 sets, in order, the first selection signals SEL1[1] to SEL1[8] to the active level in eight (K=8) selection periods S[1] to S[8] (refer to SEL[1] to SEL[K] illustrated in FIG. 4).

During the write period $T_{WRT}$ within the selection period of the scanning line 12 of the m-th row, the second supply circuit 200*b*1 sets, in a time-division manner, the data signals C[jeven] to the gradation potential $V_G$ according to the designated gradation of the pixels $P_{IX}$ corresponding to the respective intersections between the scanning line 12 of the m-th row and the signal lines 14 in the wiring groups B[jeven].

Further, during the write period $T_{WRT}$, the second supply circuit 200*b*1 sets, in order, the second selection signals SEL2[1] to SEL2[8] to the active level in eight (K=8) selection periods S[1] to S[8] (refer to SEL[1] to SEL[K] illustrated in FIG. 4).

In a case where the output value $A_{out}$=0 in the write period $T_{WRT}$ (refer to FIG. 8, the first control signals Co1[1] to Co1[8] are in an active level and the second control signals Co2[1] to Co2[8] are in an inactive level), the signal selection circuit 200*c* outputs the first selection signals SEL1[1] to SEL1[8] to the selection signal lines 61[1] to 61[8], respectively. At this time, the signal selection circuit 200*c* does not output the second selection signals SEL2[1] to SEL2[8] to the selection signal lines 61[1] to 61[8].

On the other hand, in a case where the output value $A_{out}$=1 in the write period $T_{WRT}$ (refer to FIG. 8, the first control signals Co1[1] to Co1[8] are in an inactive level and the second control signals Co2[1] to Co2[8] are in an active level), the signal selection circuit 200*c* outputs the second selection signals SEL2[1] to SEL2[8] to the selection signal lines 61[1] to 61[8], respectively. At this time, the signal selection circuit 200*c* does not output the first selection signals SEL1[1] to SEL1[8] to the selection signal lines 61[1] to 61[8].

Therefore, in the selection periods S[k] for which the scanning line 12 of the m-th row is selected, the k-th switches 58[*k*] (total J switches 58[*k*]) among the K switches 58[1] to 58[8] in each of the distribution circuits 21[1] to 21[J] transition to the turned-on state. Accordingly, the gradation potential $V_G$ of the data signals C[j] is supplied to the signal lines 14 of the k-th columns of the respective wiring groups B[j].

That is, during the write period $T_{WRT}$ within each unit period U, in each of the J wiring groups B[1] to B[J], the gradation potential $V_G$ is supplied to the eight (K=8) signal lines 14 in the corresponding wiring groups B[j] in a time-division manner. In the selection periods S[k] within the m-th unit period U, the gradation potential $V_G$ is set according to the designated gradation of the pixel $P_{IX}$ corresponding to the respective intersections between the scanning line 12 of the m-th row and the signal lines 14 of the k-th column in the wiring groups B[j].

According to the present embodiment, for each of the first period for which the output value $A_{out}$ is "0" and the second period for which the output value $A_{out}$ is "1", the selection signals to be selected are set according to the supply source of the selection signals. Therefore, selection of the selection signals for each period can be easily set.

In addition, in the present embodiment, the first period and the second period are line periods, and the first period and the second period are alternately repeated. In this case, switching between the first selection signals SEL1 and the second selection signals SEL2 is performed for each one or more lines within one frame. Thus, it is possible to make deterioration in image quality inconspicuous.

According to the present embodiment, for each pair of the first selection signals SEL1[*k*] output from the first supply circuit 200*a*1 and the second selection signals output from the second supply circuit 200*b*1, the signal selection circuit 200*c* selects, among two sides of the first selection signals and the second selection signals that constitute the pair, the selection signals on one side in the first period, and selects the selection signals on the other side in the second period.

The distribution circuit group 21 forms an image by distributing the data signals C[jodd] output from the first supply circuit 200*a*1 and the second data signals C[jeven] output from the second supply circuit 200*b*1, to the plurality of signal lines 14, using the selection signals selected by the signal selection circuit 200*c*.

Thus, in an average time of the total period of the first period and the second period, both of the first selection signals SEL1[*k*] and the second selection signals SEL2[*k*] are used, and a difference in the operation condition between the first supply circuit 200*a*1 and the second supply circuit 200*b*1 is reduced. Therefore, it is possible to suppress variations between the data signals C[jodd] and the data signals C[jeven] due to the difference in the operation condition between the first supply circuit 200*a*1 and the second supply circuit 200*b*1, and thus it is possible to suppress deterioration in image quality.

In the present embodiment, in a case where J is an even number of four or more, the plurality of wiring groups B[jodd] and the plurality of wiring groups B[jeven] are present. As illustrated in FIG. 2, the wiring groups B[jodd] and the wiring groups B[jeven] are disposed alternately. Therefore, pixel groups driven by different supply circuits can be alternately disposed, and thus it is possible to make a difference in image quality between the pixel groups inconspicuous.

Second Embodiment

The second embodiment of the invention is obtained by modifying the setting example of the relationship between the output value $A_{out}$ and the output of the signal selection circuit 200*c*, which is illustrated in FIG. 7 in the first embodiment. The basic configuration of the second embodiment is the same as that of the first embodiment. Hereinafter, the second embodiment will be described focusing on differences from the first embodiment.

FIG. 9 is a diagram illustrating a setting example of a relationship between an output value $A_{out}$ and an output of a signal selection circuit 200*c*. In FIG. 9, the vertical direction corresponds to the rows (lines) of the scanning lines 12, the horizontal direction corresponds to frames, and n−1 frame to n+3 frame are illustrated.

In FIG. 9, when the output value $A_{out}$=0, it means that the signal selection circuit 200*c* outputs the first selection signals SEL1[1], SEL1[3], SEL1[5], and SEL1[7], and the second selection signals SEL2[2], SEL2[4], SEL2[6], and SEL2[8]. At this time, the signal selection circuit 200*c* does not output the first selection signals SEL1[2], SEL1[4], SEL1[6], and SEL1[8], and the second selection signals SEL2[1], SEL2[3], SEL2[5], and SEL2[7].

Figure 10:
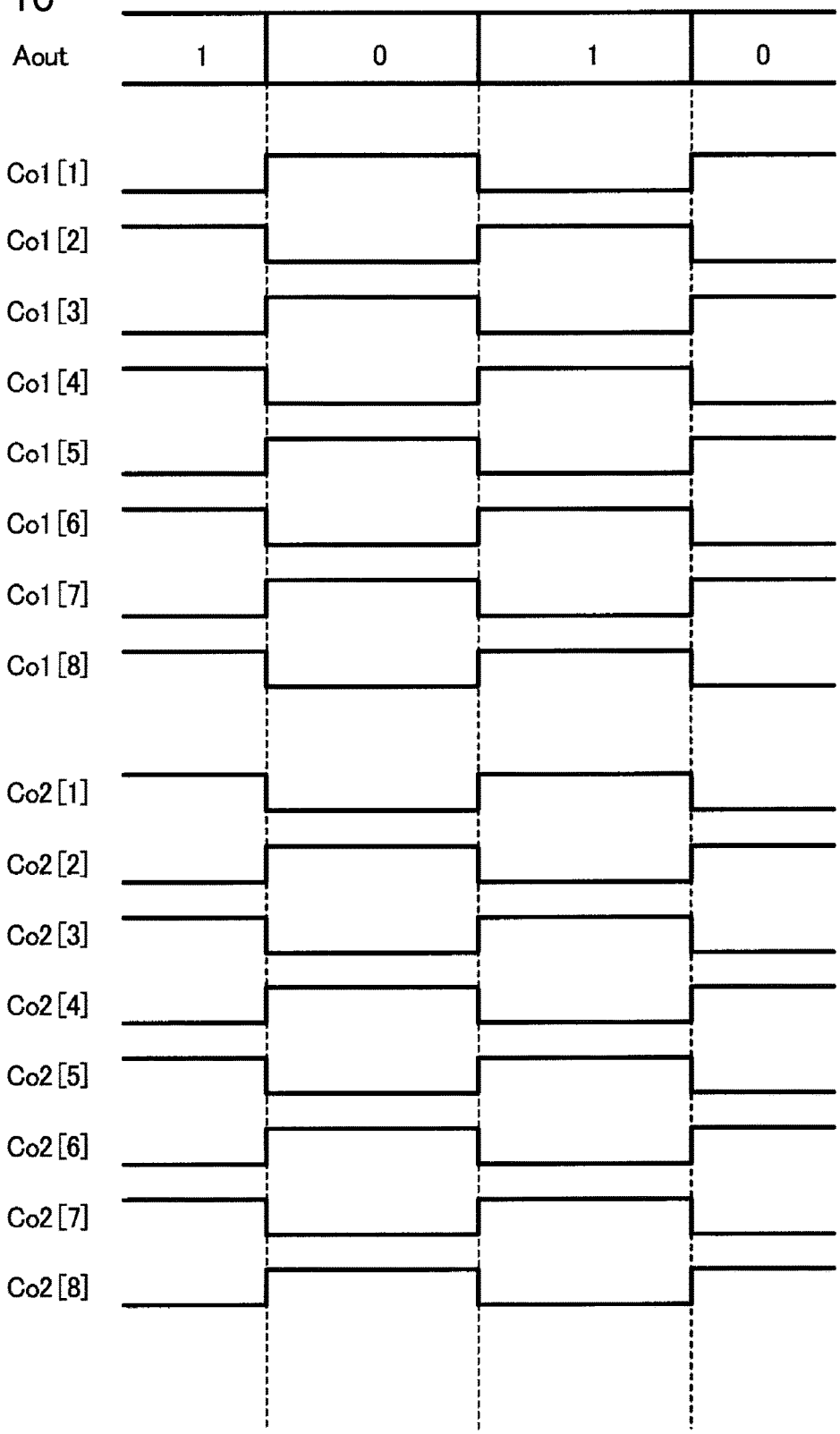
FIG. 10 is an explanatory diagram of outputs of a first control signal and a second control signal.

In this case, as illustrated in FIG. 10, when the output value $A_{out}$=0, each control signal generation circuit 60*c*4 in the control signal supply circuits 60*a* and 60*b* sets the first control signals Co1[1], Co1[3], Co1[5], and Co1[7], and the second control signals Co2[2], Co2[4], Co2[6], and Co2[8], to an active level. At this time, as illustrated in FIG. 10, each control signal generation circuit 60*c*4 in the control signal supply circuits 60*a* and 60*b* sets the first control signals Co1[2], Co1[4], Co1[6], and Co1[8], and the second control signals Co2[1], Co2[3], Co2[5], and Co2[7], to an inactive level.

Therefore, when the output value $A_{out}$=0, the switches 59*a*[1], 59*a*[3], 59*a*[5], and 59*a*[7] in the selection circuit 200*a*2, and the switches 59*b*[2], 59*b*[4], 59*b*[6], and 59*b*[8] in the selection circuit 200*b*2 come into the turned-on state (conductive state). At this time, the switches 59*a*[2], 59*a*[4], 59*a*[6], and 59*a*[8] in the selection circuit 200*a*2 and the switches 59*b*[1], 59*b*[3], 59*b*[5], and 59*b*[7] in the selection circuit 200*b*2 come into the turned-off state (high impedance state).

Therefore, when the output value $A_{out}$=0, the signal selection circuit 200*c* outputs the first selection signals SEL1[1], SEL1[3], SEL1[5], and SEL1[7], and the second selection signals SEL2[2], SEL2[4], SEL2[6], and SEL2[8]. At this time, the signal selection circuit 200*c* does not output the first selection signals SEL1[2], SEL1[4], SEL1[6], and SEL1[8], and the second selection signals SEL2[1], SEL2[3], SEL2[5], and SEL2[7].

In addition, in FIG. 9, when the output value $A_{out}$=1, it means that the signal selection circuit 200*c* outputs the first selection signals SEL1[2], SEL1[4], SEL1[6], and SEL1[8], and the second selection signals SEL2[1], SEL2[3], SEL2[5], and SEL2[7]. At this time, the signal selection circuit 200*c* does not output the first selection signals SEL1[1], SEL1[3], SEL1[5], and SEL1[7], and the second selection signals SEL2[2], SEL2[4], SEL2[6], and SEL2[8].

In this case, as illustrated in FIG. 10, when the output value $A_{out}$=1, each control signal generation circuit 60*c*4 in the control signal supply circuits 60*a* and 60*b* sets the first control signals Co1[2], Co1[4], Co1[6], and Co1[8], and the second control signals Co2[1], Co2[3], Co2[5], and Co2[7], to an active level. At this time, as illustrated in FIG. 10, each control signal generation circuit 60*c*4 in the control signal supply circuits 60*a* and 60*b* sets the first control signals Co1[1], Co1[3], Co1[5], and Co1[7], and the second control signals Co2[2], Co2[4], Co2[6], and Co2[8], to an inactive level.

Therefore, when the output value $A_{out}$=1, the switches 59*a*[2], 59*a*[4], 59*a*[6], and 59*a*[8] in the selection circuit 200*a*2, and the switches 59*b*[1], 59*b*[3], 59*b*[5], and 59*b*[7] in the selection circuit 200*b*2 come into the turned-on state (conductive state). At this time, the switches 59*a*[2], 59*a*[4], 59*a*[6], and 59*a*[8] in the selection circuit 200*a*2 and the switches 59*b*[1], 59*b*[3], 59*b*[5], and 59*b*[7] in the selection circuit 200*b*2 come into the turned-off state (high impedance state).

Therefore, when the output value $A_{out}$=1, the signal selection circuit 200*c* outputs the first selection signals SEL1[2], SEL1[4], SEL1[6], and SEL1[8], and the second selection signals SEL2[1], SEL2[3], SEL2[5], and SEL2[7]. At this time, the signal selection circuit 200*c* does not output the first selection signals SEL1[1], SEL1[3], SEL1[5], and SEL1[7], and the second selection signals SEL2[2], SEL2[4], SEL2[6], and SEL2[8].

According to the present embodiment, in each of the first period for which the output value $A_{out}$ is "0" and the second period for which the output value $A_{out}$ is "1", a portion of the first selection signals SEL1 from the first supply circuit 200*a*1 and a portion of the second selection signals SEL2 from the second supply circuit 200*b*1 are used. Thus, in each period, a difference in the operation condition between the first supply circuit 200*a*1 and the second supply circuit 200*b*1 can be reduced. Therefore, in each period, it is possible to suppress deterioration in image quality due to a difference in the operation condition between the first supply circuit 200*a*1 and the second supply circuit 200*b*1.

In the present embodiment, as a portion of the first selection signals SEL1, the first selection signals SEL1[*k*] (k is an odd number) are used, and as a portion of the second selection signals SEL2, the second selection signals SEL2[*k*] (k is an even number) are used. However, a portion of the first selection signals SEL1 and a portion of the second selection signals SEL2 can be appropriately changed.

MODIFICATION EXAMPLE

The above embodiments can be modified in a variety of other forms. Specific modification forms are exemplified below. Two or more forms arbitrarily selected from the following examples can be appropriately combined unless the forms are inconsistent with each other.

Modification Example 1

In the control signal supply circuit 60*c*, the horizontal counter 60*c*2 may be omitted. In this case, as compared with the case where the horizontal counter 60*c*2 is present, the frequency of switching the selection signals decreases, but it is possible to perform switching using only the vertical synchronization signal $V_{SYNC}$ that defines the frame period.

Modification Example 2

When the horizontal counter 60*c* is omitted and a plurality of vertical synchronization signals $V_{SYNC}$ are input, as the vertical counter 60*c*1, a counter that counts up may be used. In this case, the first period and the second period are periods of two or more frames.

In particular, in the present embodiment, the polarity of the first data signals and the polarity of the second data signals are inverted in a frame unit (refer to FIG. 4). Thus, as the vertical counter 60*c*1, a counter that counts up when the vertical synchronization signal $V_{SYNC}$ is input twice, is preferably used. In this case, a difference in polarity between the frames within the first and second periods, is canceled, and the supply source of the selection signals which are used by the distribution circuit group 21 is further switched. Thus, it is possible to suppress deterioration in image quality.

Modification Example 3

In a case where J is an even number of four or more, the first supply circuit 200*a* and the second supply circuit 200*b* may be stacked such that each of the plurality of data lines 16 connected to the first supply circuit 200*a* via the connection terminal 300*a*1 is adjacent to each of the plurality of data lines 16 connected to the second supply circuit 200*b* via the connection terminal 300*b*1. As illustrated in FIGS. 1 and 2, the connection terminal 300*a*1 and the connection terminal 300*b*1 are disposed side by side at an interval in a direction in which the signal lines 14 extend, and are connected to the data lines 16.

In this case, the pitch between the data lines 16 including the plurality of data lines 16 connected to the first supply circuit 200*a* and the plurality of data lines 16 connected to the second supply circuit 200*b*, can be made smaller than the pitch between the plurality of data lines 16 connected to the first supply circuit 200*a*. In addition, the pitch between the data lines 16 including the plurality of data lines 16 connected to the first supply circuit 200*a* and the plurality of data lines 16 connected to the second supply circuit 200*b*, can be made smaller than the pitch between the plurality of data lines 16 connected to the second supply circuit 200*b*. In addition, it becomes easier to alternately dispose the pixel groups to which the data signals C[jodd] are supplied from the first supply circuit 200*a* and the pixel groups to which the data signals C[jeven] are supplied from the second supply circuit 200*b*. Thus, when the pixel groups are disposed in this way, it is possible to make a difference in image quality between the pixel groups inconspicuous.

Modification Example 4

The selection circuit 200*a*2 may be incorporated in the first supply circuit 200*a*1. In addition, the selection circuit 200*b*2 may be incorporated in the second supply circuit 200*b*1.

Modification Example 5

In the above-described embodiments, the first supply circuit 200*a*1 may drive the distribution circuits 21[1] to 21[J/2], and the second supply circuit 200*b*1 may drive the distribution circuits 21[(J/2)+1] to 21[J]. In this case, since the distribution circuits 21[1] to 21[J/2] and the distribution circuits 21[(J/2)+1] to 21[J] can be easily divided in terms of position, it is possible to simplify the wiring between the distribution circuits 21[1] to 21[J] and the first supply circuit 200*a*1 and between the distribution circuits 21[1] to 21[J] and the second supply circuit 200*b*1.

Modification Example 6

The first flexible printed circuit board 300*a* may be connected to one side of the electrooptical panel 100, and the second flexible printed circuit board 300*b* may be connected to the other side opposite to the one side of the electrooptical panel 100. In this case, the distribution circuit group 21 is also distributed and disposed on the side to which the first flexible printed circuit board 300*a* is connected and the side to which the second flexible printed circuit board 300*b* is connected.

Application Example

The electrooptical device 1 exemplified in each of the above embodiments and modification examples can be used for various electronic apparatuses.

Figure 11:
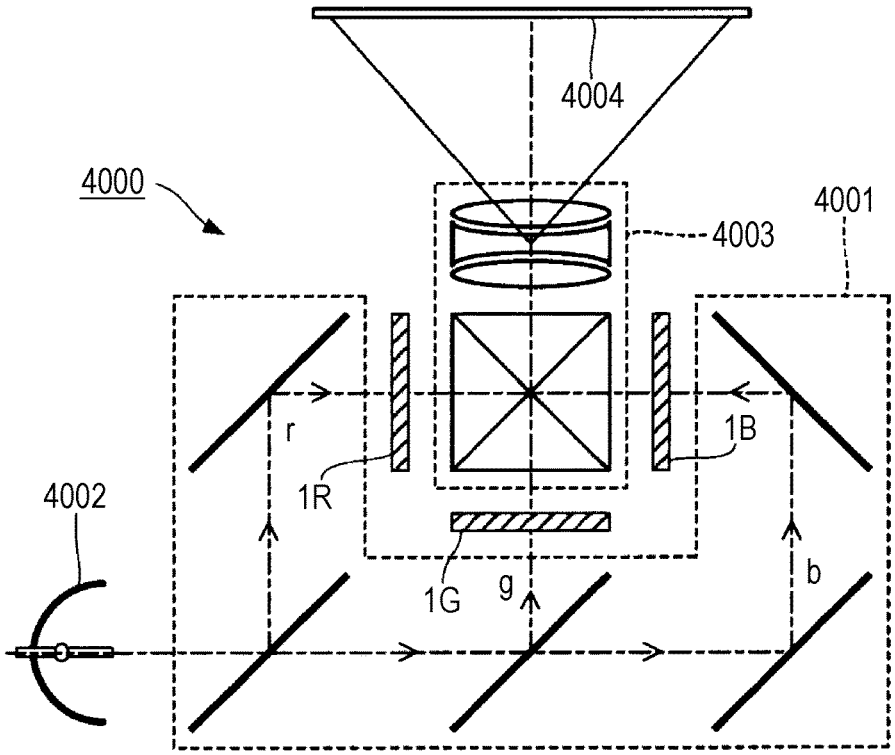
FIG. 11 is a perspective view illustrating a form of an electronic apparatus (a projection type display apparatus).

FIG. 11 is a schematic diagram of a projection type display apparatus (three-plate type projector) 4000 to which the electrooptical device 1 is applied. The projection type display apparatus 4000 is configured to include three electrooptical devices 1 (1R, 1G, and 1B) corresponding to different display colors (red, green, and blue). An illumination optical system 4001 supplies red components r among light emitted from an illumination device (light source) 4002 to the electrooptical device 1R, supplies green components g to the electrooptical device 1G, and supplies blue components b to the electrooptical device 1B. Each of the electrooptical devices 1 functions as an optical modulator (light valve) that modulates monochromatic light supplied from the illumination optical system 4001 according to the display image. A projection optical system 4003 combines the light emitted from the respective electrooptical panels 100 and projects the combined light on a projection surface 4004.

The electronic apparatuses to which the electrooptical device according to the invention is applied include a personal digital assistants (PDA), a digital still camera, a television, a video camera, and a car navigation device, in addition to the apparatus illustrated in FIG. 11. Further, the electronic apparatuses include an in-vehicle display apparatus (instrument panel), an electronic organizer, an electronic paper, a calculator, a word processor, a workstation, a video phone, a POS terminal, a printer, a scanner, a copier, a video player, an apparatus including a touch panel, and the like.

Priority is claimed under 35 U.S.C. § 119 to Japanese Application No. 2016-146020 filed on Jul. 26, 2016, which is hereby incorporated by reference in its entirety.

What is claimed is:

1. An electrooptical device comprising:

a first signal line group;

a second signal line group different from the first signal line group;

a signal distribution circuit that executes a distribution operation of distributing first data signals to signal lines in the first signal line group and distributing second data signals to signal lines in the second signal line group;

a first supply circuit that supplies the first data signals to the signal distribution circuit and supplies first selection signals for controlling distribution of the first data signals to the signal lines in the first signal line group;

a second supply circuit that supplies the second data signals to the signal distribution circuit and supplies second selection signals for controlling distribution of the second data signals to the signal lines in the second signal line group; and a selection circuit that controls output of the first selection signals and the second selection signals to the signal distribution circuit.

2. The electrooptical device according to claim 1, wherein the first signal line group, the second signal line group, and the signal distribution circuit are provided in an electrooptical panel, wherein the first supply circuit and the selection circuit are provided in a first generation circuit connected to the electrooptical panel via a first flexible printed circuit board, and wherein the second supply circuit and the selection circuit are provided in a second generation circuit connected to the electrooptical panel via a second flexible printed circuit board.

3. The electrooptical device according to claim 2, wherein the first supply circuit generates the first data signals and the first selection signals, and wherein the second supply circuit generates the second data signals and the second selection signals.

4. The electrooptical device according to claim 2, wherein the first flexible printed circuit board and the second flexible printed circuit board are partially stacked and connected to one side of the electrooptical panel.

5. The electrooptical device according to claim 2, wherein the first flexible printed circuit board is connected to one side of the electrooptical panel and the second flexible printed circuit board is connected to the other side opposite to the one side of the electrooptical panel.

6. An electrooptical device comprising:

a plurality of pixels that are disposed corresponding to the respective intersections between 2K (K is a natural number of two or more) or more signal lines and two or more scanning lines, and that display gradation according to signals supplied to the signal lines when the scanning lines are selected;

a scanning line driving circuit that sequentially selects the respective two or more scanning lines;

a first generation circuit that generates first data signals and a plurality of first selection signals, the first data signals for supplying the signals to the respective signal lines in a first signal line group with K signal lines;

a second generation circuit that generates second data signals and second selection signals corresponding to the first selection signals for each of the first selection signals, the second data signals for supplying the signals to the respective signal lines in a second signal line group with K signal lines different from the K signal lines belonging to the first signal line group; and a signal distribution circuit that executes a distribution operation of distributing the first data signals to the respective signal lines in the first signal line group, and distributing the second data signals to the respective signal lines in the second signal line group, wherein, the first generation circuit, in a first period, outputs, among the plurality of first selection signals, zero or more first selection signals, and in a second period, outputs the first selection signals which are not output in the first period among the plurality of first selection signals, wherein, the second generation circuit, in the first period, outputs, among the plurality of second selection signals, the second selection signals corresponding to the first selection signals which are not output in the first period by the first generation circuit, and in the second period, outputs the second selection signals which are not output in the first period among the plurality of second selection signals, and wherein, the signal distribution circuit, in the first period, executes the distribution operation using the selection signals which are output in the first period among the plurality of first selection signals and the plurality of second selection signals, and in the second period, executes the distribution operation using the selection signals which are output in the second period among the plurality of first selection signals and the plurality of second selection signals.

7. The electrooptical device according to claim 6, wherein the first generation circuit outputs, in the first period, the plurality of first selection signals.

8. The electrooptical device according to claim 6, wherein the first generation circuit outputs, in the first period, a portion of the plurality of first selection signals.

9. The electrooptical device according to claim 6, wherein the first period and the second period are periods of one or more frames, and wherein the first period and the second period are alternately repeated.

10. The electrooptical device according to claim 9, wherein the polarity of the first data signals and the polarity of the second data signals are inverted in a frame unit, and wherein the first period and the second period are periods of two frames.

11. The electrooptical device according to claim 6, wherein the first period and the second period are periods of one or more lines, and wherein the first period and the second period are alternately repeated.

12. The electrooptical device according to claim 6, wherein a plurality of first signal line groups and a plurality of second signal line groups are present, and wherein the first signal line group and the second signal line group are alternately disposed.

13. The electrooptical device according to claim 12, wherein the first generation circuit is connected to the first signal line groups via first data lines for each of the first signal line groups, wherein the second generation circuit is connected to the second signal line groups via second data lines for each of the second signal line groups, and wherein the first generation circuit is connected to the first data lines via a connection terminal and the second generation circuit is connected to the second data lines via a connection terminal such that the first data lines and the second data lines are alternately disposed side by side.

14. A method for controlling an electrooptical device including a plurality of pixels that are disposed corresponding to the respective intersections between 2K (K is a natural number of two or more) or more signal lines and two or more scanning lines, and that display gradation according to signals supplied to the signal lines when the scanning lines are selected, comprising:

selecting sequentially each of the two or more scanning lines;

generating, by a first generation circuit, first data signals and a plurality of first selection signals, the first data signals for supplying the signals to the respective signal lines in a first signal line group with K signal lines;

generating, by a second generation circuit, second data signals and second selection signals corresponding to the first selection signals for each of the first selection signals, the second data signals for supplying the signals to the respective signal lines in a second signal line group with K signal lines different from the K signal lines belonging to the first signal line group;

executing, in a first period, by outputting, among the plurality of first selection signals, zero or more first selection signals, and outputting, among the plurality of second selection signals, the second selection signals corresponding to the first selection signals which are not output in the first period, a distribution operation of distributing the first data signals to the respective signal lines in the first signal line group and distributing the second data signals to the respective signal lines in the second signal line group, using the selection signals which are output in the first period among the plurality of first selection signals and the plurality of second selection signals; and executing, in a second period, by outputting, among the plurality of first selection signals, the first selection signals which are not output in the first period, and outputting, among the plurality of second selection signals, the second selection signals which are not output in the first period, the distribution operation using the selection signals which are output in the second period among the plurality of first selection signals and the plurality of second selection signals.

15. The method for controlling an electrooptical device according to claim 14, wherein the first generation circuit outputs, in the first period, the plurality of first selection signals.

16. The method for controlling an electrooptical device according to claim 14, wherein the first generation circuit outputs, in the first period, a portion of the plurality of first selection signals.

17. The method for controlling an electrooptical device according to claim 14, wherein the first period and the second period are periods of one or more frames, and wherein the first period and the second period are alternately repeated.

18. The method for controlling an electrooptical device according to claim 17, wherein the polarity of the first data signals and the polarity of the second data signals are inverted in a frame unit, and wherein the first period and the second period are periods of two frames.

19. The method for controlling an electrooptical device according to claim 14, wherein the first period and the second period are periods of one or more lines, and wherein the first period and the second period are alternately repeated.

20. An electronic apparatus comprising:

the electrooptical device according to claim 1.

* * * * *